United States Patent [19]

Ono

[11] Patent Number: 4,632,380

[45] Date of Patent: Dec. 30, 1986

[54] PAPER FEEDING APPARATUS

[75] Inventor: Yoshiaki Ono, Shizuoka, Japan

[73] Assignee: Tokyo Electric Co., Ltd., Tokyo, Japan

[21] Appl. No.: 756,783

[22] Filed: Jul. 18, 1985

[30] Foreign Application Priority Data

Jul. 31, 1984 [JP] Japan ..... 59-160596

[51] Int. Cl.[4] ..... B65H 1/12

[52] U.S. Cl. ..... 271/127; 271/160

[58] Field of Search ..... 271/22, 126, 127, 160

[56] References Cited

U.S. PATENT DOCUMENTS

| | | | |
|---|---|---|---|
| 390,277 | 10/1888 | Allen | 271/121 |
| 3,430,748 | 3/1969 | Parri . | |
| 3,598,396 | 8/1971 | Andrews et al. . | |
| 3,919,972 | 11/1975 | Komori | 271/160 X |
| 4,394,009 | 7/1983 | Bergman | 271/186 X |
| 4,511,135 | 4/1985 | Huerta | 271/126 |

*Primary Examiner*—Richard A. Schacher

*Attorney, Agent, or Firm*—Frishauf, Holtz, Goodman & Woodward

[57] ABSTRACT

A paper feeding apparatus comprises a paper-supply roller, a movable plate opposed to the paper-supply roller, carrying thereon a plurality of paper sheets in a pile and urging the paper sheets toward the paper-supply roller, two openings formed in the movable plate so as to substantially face the paper-supply roller, two backup members attached to the openings so as to be movable in a direction crossing a sheet carrying surface of the movable plate, and two springs for urging the backup members toward the paper-supply roller to press the paper sheets placed on the movable plate against the paper-supply roller whereby the paper-supply roller delivers the paper sheets one after another.

8 Claims, 5 Drawing Figures

PAPER FEEDING APPARATUS

BACKGROUND OF THE INVENTION

The present invention relates to a paper feeding apparatus for automatically feeding paper sheets to a paper sheet processing machine, which comprises a paper-supply roller and a movable plate opposed to the paper-supply roller, carrying thereon a plurality of paper sheets in a pile and urging the paper sheets toward the paper-supply roller, whereby the paper sheets placed on the movable plate is pressed against the paper-supply roller so that the paper-supply roller delivers the paper sheets one after another.

In a conventional paper feeding apparatus of this type, the movable plate is attached to the frame of the apparatus so as to move toward or away from the paper-supply roller rotatably supported by the frame. The movable plate is formed as an integral structure which moves relative to the frame. Also, the movable plate is urged to move toward the paper-supply roller by urging means.

In the prior art paper feeding apparatus of this construction, if the movable plate suffers torsion or any other deformation, the contact pressure of the paper-supply roller on the paper sheets placed on the movable plate will be unevenly distributed. This will possibly cause the paper sheets to be fed to the paper sheet processing machine to skew and hence trouble in the machine.

SUMMARY OF THE INVENTION

The present invention is contrived in consideration of these circumstances, and is intended to provide a paper feeding apparatus capable of feeding paper sheets to a paper sheet processing machine without uneven distribution of the contact pressure of a paper-supply roller on the paper sheets placed on a movable plate and without skewing the paper sheets being fed to the paper sheet processing machine even if the movable plate is subject to deformation, such as torsion.

The above object of the present invention may be achieved by a paper feeding apparatus which comprises a paper-supply roller, a movable plate opposed to the paper-supply roller, carrying thereon a plurality of paper sheets in a pile and urging the paper sheets toward the paper-supply rollers, opening means formed in the movable plate so as to substantially face the paper-supply roller, at least one backup member attached to the opening means so as to be movable in a direction crossing a sheet carrying surface of the movable plate, and urging means for urging the backup member toward the paper-supply roller to press the paper sheets placed on the movable plate against the paper-supply roller whereby the paper-supply roller delivers the paper sheets one after another.

Preferably, in the paper feeding apparatus of the invention constructed in this manner, the opening means includes two openings fitted individually with two backup members, the two openings being located in positions corresponding individually to both end portions of each paper sheet on the movable plate as viewed along the longitudinal direction of the paper-supply roller.

With this arrangement, the aforesaid object of the invention can be achieved more effectively, and the number of components used in the apparatus is moderate.

In the paper feeding apparatus of the invention, moreover, the urging means preferably includes an urging force adjusting mechanism for adjusting the urging force.

With this arrangement, the distribution of the contact pressure of the paper sheets on the movable plate pressed against the paper-supply roller can conveniently be adjusted with high accuracy.

In the paper feeding apparatus of the invention, furthermore, the urging force adjusting mechanism preferably includes a rear plate facing the back surface of the movable plate opposite to the sheet carrying surface thereof at a distance therefrom, a screw member rotatably attached to the rear plate, and a moving member disposed between the movable plate and the rear plate and threaded with the screw member so as to move toward or away from the back surface of the movable plate as the screw member is rotated in one or the other direction, and a compression spring preferably is interposed between the backup member and the moving member.

Such an urging force adjusting mechanism is simple in construction and operates with high reliability.

If the opening means of the paper feeding apparatus includes two openings for the two backup members, the urging means preferably is provided corresponding to the two individual backup members.

One embodiment of the present invention will now be described in detail with reference to the accompanying drawings.

DETAILED DESCRIPTION OF THE PREFERRED EMBODIMENT

Figure 1:
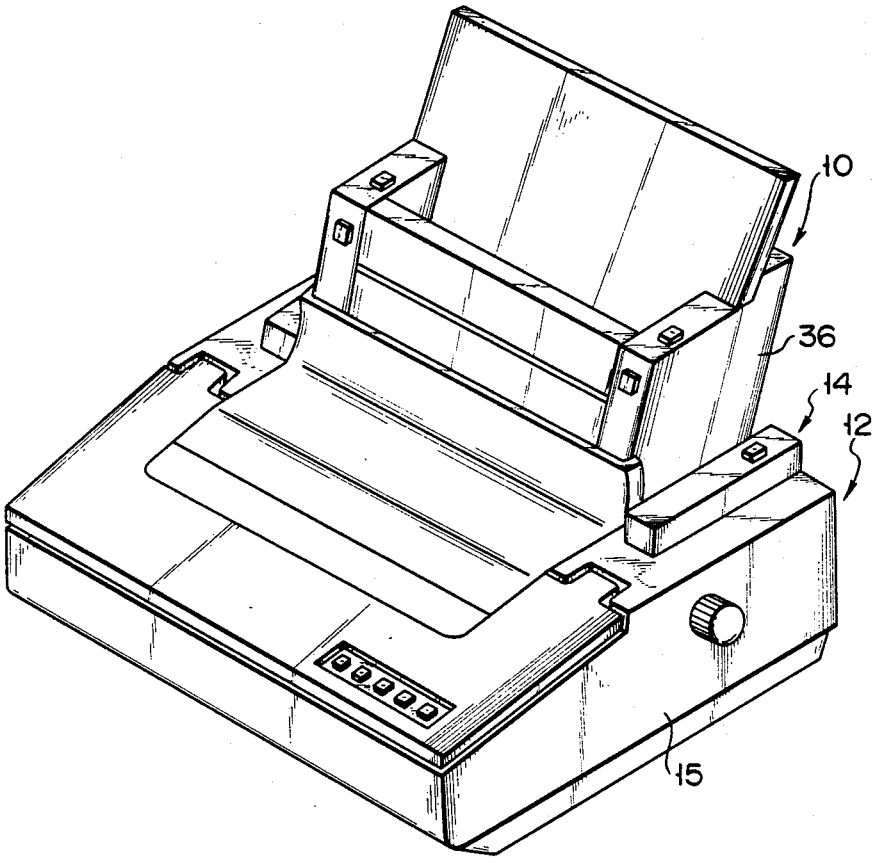
FIG. 1 is a perspective view schematically showing a printing apparatus provided with a paper feeding apparatus according to an embodiment of the present invention.

Referring now to FIG. 1, there is shown a printing apparatus 12 provided with a paper feeding apparatus 10 according to one embodiment of the present invention. The paper feeding apparatus 10 is removably coupled to the printing apparatus 12 by means of mounting blocks 14 attached to the printing apparatus 12. The printing apparatus 12 is of a conventionally known type.

Figure 2:
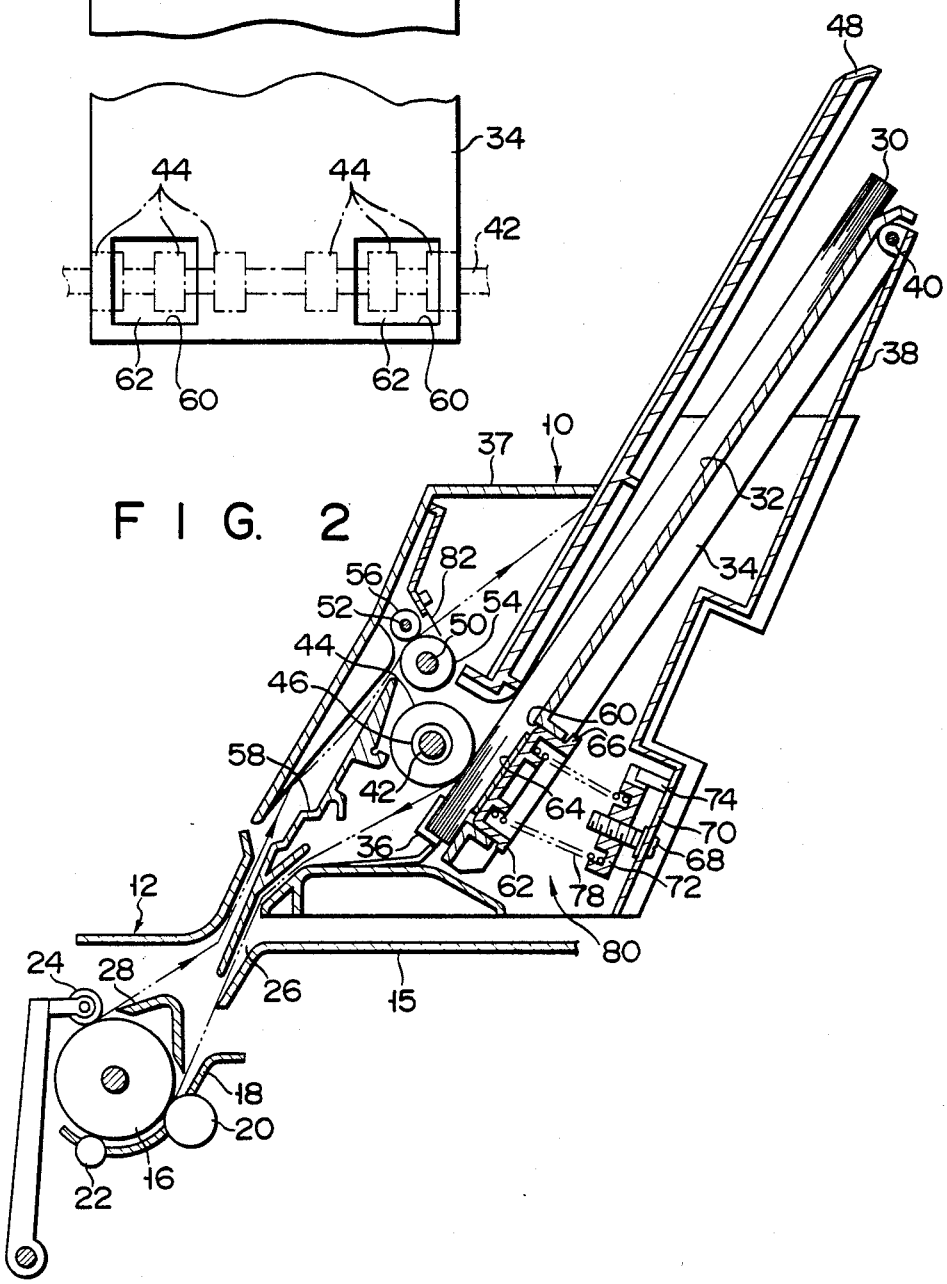
FIG. 2 is a vertical sectional view schematically showing the paper feeding apparatus and printing apparatus of FIG. 1.
Figure 4:
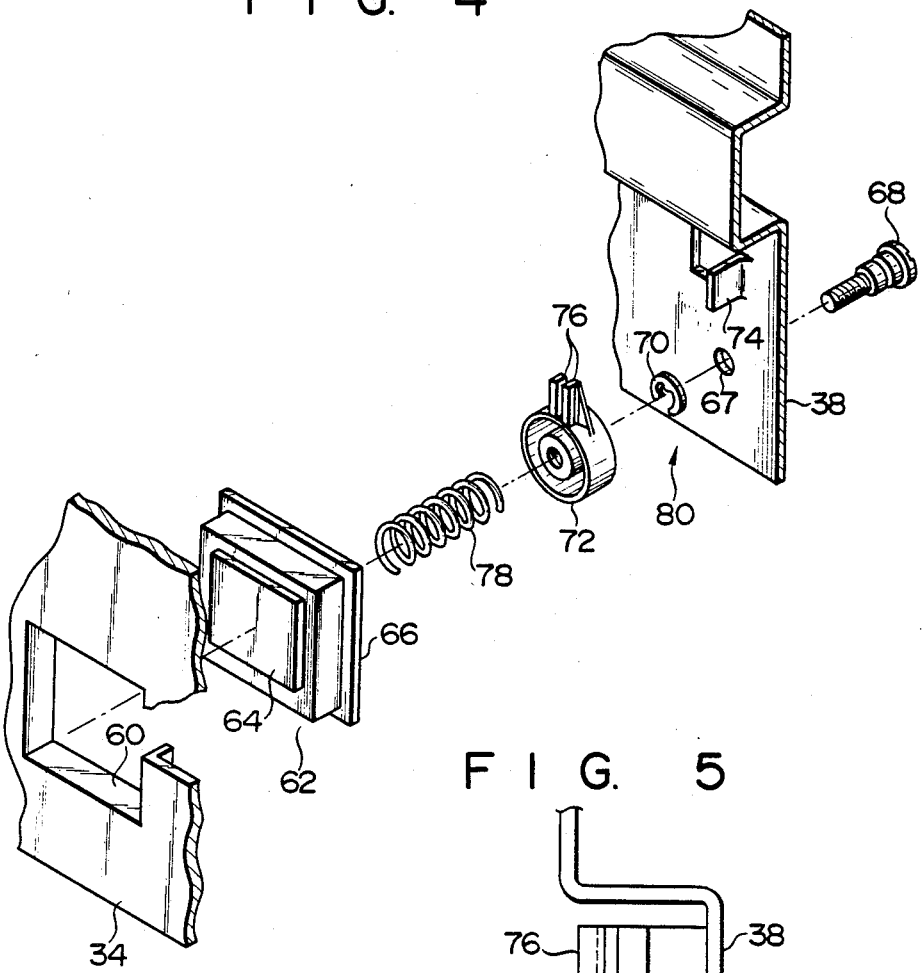
FIG. 4 is an exploded perspective view showing a backup member, compression coil spring, and urging force adjusting mechanism each of which is arranged between the movable plate and a rear plate shown in FIG. 2.
Figure 5:
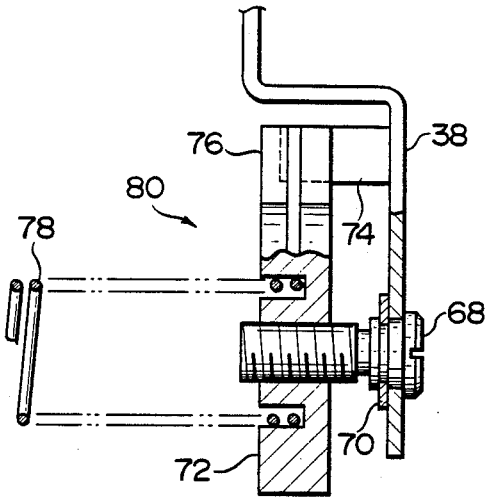
FIG. 5 is an enlarged side view partially in section showing the compression coil spring, urging force adjusting mechanism, and rear plate of FIG. 2.

As shown in FIG. 2, a platen 16 is disposed in a housing 15 of the printing apparatus 12. The lower half of the outer peripheral surface of the platen 16 is substantially covered with a paper pan 18. The outer peripheral surface of the platen 16 is in contact with a bail roller 24 located above, as well as with pinch rollers 20 and 22 penetrating the paper pan 18. Also, a printing head (not shown) faces the outer peripheral surface of the platen 16 from the left in FIG. 2. A sheet passage aperture 26 is formed in the housing 15 of the printing apparatus 12, located off to the upper right of the platen 16. In the vicinity of the outer peripheral surface of the platen 16, a guide member 28 is disposed between the bail roller 24 and the paper pan 18 so as to have its angle portion projecting toward the sheet passage aperture 26.

The paper feeding apparatus 10 is provided with a movable plate 34 which has a sheet carrying surface 32 carrying thereon a pile of paper sheets 30 of a specified size. Sheet separating members 36 are attached individually to the two lower corner portions of the movable plate 34. A rear plate 38 of a housing 37 of the paper feeding apparatus 10 is rearwardly spaced from the back of the movable plate 34 opposite to the sheet carrying surface 32. The upper end of the movable plate 34 is rotatably coupled to a shaft 40 which is fixed to the upper end of the rear plate 38.

Figure 3:
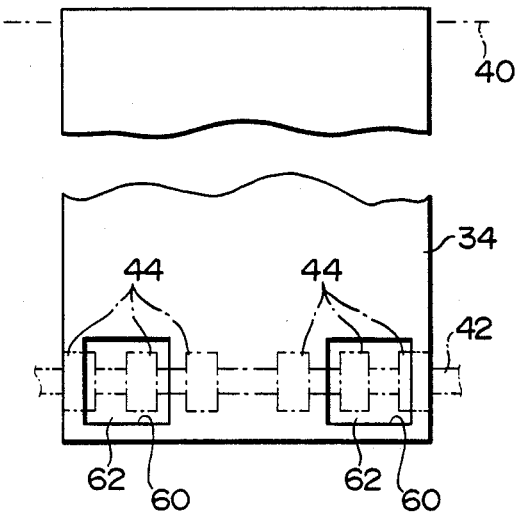
FIG. 3 is a schematic front view of a movable plate shown in FIG. 2.

A paper-supply roller driving shaft 42 is disposed in front of the lower end portion of the sheet carrying surface 32 of the movable plate 34 and is rotatably supported by the housing 37 of the paper feeding apparatus 10. As shown in FIGS. 2 and 3, a plurality of paper-supply rollers 44 are mounted on the paper-supply roller driving shaft 42 by means of a one-way clutch 46 and are spaced in the longitudinal direction of the shaft 42 apart from each other. The paper-supply roller driving shaft 42 is supplied with driving force by a motor (not shown).

As shown in FIG. 2, a sheet receiving plate 48 is fixed to the housing 37 of the paper feeding apparatus 10 and is located in front of the sheet carrying surface 32 of the movable plate 34 at a predetermined distance therefrom. An exit roller driving shaft 50 and a free-rotation shaft 52 are arranged in the vicinity of the lower end of the sheet receiving plate 48 and extend parallel to the paper-supply roller driving shaft 42. The shafts 50 and 52 are rotatably supported by the housing 37 of the paper feeding apparatus 10. An exit roller 54 is fixed on the outer peripheral surface of the exit roller driving shaft 50, while a pinch roller 56 in contact with the exit roller 54 is mounted on the outer peripheral surface of the free-rotation shaft 52. The exit roller driving shaft 50 is driven by a motor (not shown). A partition plate 58 extends downward from a region near the exit roller 54, having its lower end inserted in the sheet passage aperture 26 of the printing apparatus 12.

As shown in FIGS. 2 and 3, two openings 60 are formed in the movable plate 34 and are substantially facing the paper-supply rollers 44. The two openings 60 are located corresponding individually to the two end portions of each paper sheet 30 on the movable plate 34 as viewed along the longitudinal direction of the paper-supply roller driving shaft 42. A backup member 62 is attached to each of the two openings 60 so as to be movable at right angles to the sheet carrying surface 32 of the movable plate 34. A cork sheet 64 is pasted on the front face of the backup member 62, whereby the paper sheet 30 is prevented from sliding. An outer flange 66 is formed on the rear edge of the backup member 62. When the outer flange 66 abuts against the back surface of the movable plate 34, the front end portion of the backup member 62 projects ahead of the sheet carrying surface 32 of the movable plate 34.

Through holes 67 are formed at positions corresponding to the backup members 62 in the rear plate 38. A screw member 68 is rotatably passed through each of the through holes 67. The screw member 68 is prevented from slipping out of the through hole 67 by an E-ring 70. A moving member 72 is screwed on the thread portion of the screw member 68. The moving member 72 is formed on its outer peripheral surface with a pair of lugs 76 between which is passed a stopper 74 formed on the rear plate 38. A compression coil spring 78 is interposed between the back surface of the backup member 62 and the front surface of the moving member 72. Thus, the screw member 68 rotatably attached to the rear plate 38 and the moving member 72 constitute an urging force adjusting mechanism 80 for adjusting the urging force of the compression coil spring 78. When the screw member 68 is rotated in either direction, the moving member 72 moves toward or away from the back surface of the movable plate 34, thereby adjusting the urging force of the compression coil spring 78.

When the pile of paper sheets 30 are not placed on the sheet carrying surface 32 of the movable plate 34, the urging force of the compression coil spring 78 is transmitted to the movable plate 34 through each one of the outer flanges 66 of the backup members 62 which are engaged with the back surface of the movable plate 34, and the movable plate 34 is urged toward the paper-supply rollers 44. But, when the pile of paper sheets 30 are placed on the sheet carrying surface 32 of the movable plate 34 so that the outer flanges 66 of the backup members 62 are spaced from the back surface of the movable plate 34, the movable plate 34 is urged to make its sheet carrying surface 32 contact the lower most one of the pile of the paper sheets 30 by elastic force of the sheet separating member 36. That is, the movable plate 34 is urged toward the paper-supply rollers 44.

In the paper feeding apparatus 10 according to the embodiment of the invention constructed in this manner, even if the movable plate 34 is subject to deformation such as torsion so that the sheet carrying surface 32 especially those portions facing the paper-supply rollers 44 is not parallel to the axis of rotation of the paper-supply roller driving shaft 42, the paper sheets 30 carried on the sheet carrying surface 32 can be pressed against the individual paper-supply rollers 44 under substantially uniform pressures by the two backup members 62. Accordingly, the uppermost one of the paper sheets 30 on the sheet carrying surface 32 can steadily be fed toward the sheet passage aperture 26 by the paper-supply rollers 44 without skewing.

The paper sheet fed in this manner is delivered to the space between the platen 16 and the paper pan 18 by the guide member 28 in the printing apparatus 12 so that it is held between the platen 16 and the pinch roller 20. After undergoing printing on the outer peripheral surface of the platen 16 by the printing head (not shown), the paper sheet is discharged to the sheet passage aperture 26 by the bail roller 24 and the guide member 28, and then guided toward the sheet receiving plate 48 by the partition plate 58. At the entrance to the sheet receiving plate 48, the printed paper sheet is held between the exit roller 54 and the pinch roller 56 and cleared of static electricity by a discharge brush 82. Thereafter, the paper sheet is put on the front surface of the sheet receiving plate 48. In FIG. 2, the path of the paper sheet transferred from the movable plate 34 to the sheet receiving plate 48 is indicated by a two-dot chain line.

What is claimed is:

1. A paper feeding apparatus comprising:

a paper-supply roller;

movable plate means opposed to the paper-supply roller for carrying thereon a plurality of paper sheets in a pile and urging the paper sheets toward the paper-supply roller;

at least one opening formed in the movable plate so as to substantially face the paper-supply roller;

a plurality of backup members protruding into said at least one opening so as to be movable in a direction crossing a sheet carrying surface of the movable plate; and urging means provided for each backup member and urging each backup member toward the paper-supply roller with an individually settable urging force to press the paper sheets placed on the movable plate against the paper-supply roller whereby the paper-supply roller delivers the paper sheets one after another.

2. The paper feeding apparatus according to claim 1, wherein said opening includes two openings fitted, respectively, with one of said backup members, said two openings being located in positions corresponding, respectively, to end portions of each paper sheet on the movable plate as viewed along the longitudinal direction of the paper-supply roller.

3. The paper feeding apparatus according to claim 1, wherein said urging means includes an urging force adjusting mechanism means for adjusting the urging force.

4. The paper feeding apparatus according to claim 3, wherein said opening includes two openings fitted, respectively, with one of said backup members, said two openings being located in positions corresponding, respectively, to end portions of each paper sheet on the movable plate as viewed along the longitudinal direction of the paper-supply roller.

5. The paper feeding apparatus according to claim 3, wherein said urging force adjusting mechanism means includes a rear plate facing a back surface of the movable plate opposite to the sheet carrying surface thereof at a distance therefrom, a screw member rotatably attached to the rear plate, and a moving member disposed between the movable plate and the rear plate and threaded with the screw member so as to move toward or away from the back surface of the movable plate as the screw member is rotated in one or the other direction, and a compression spring interposed between the backup member and the moving member.

6. The paper feeding apparatus according to claim 5, wherein said opening means includes two openings fitted, respectively, with one of said backup members, said two openings being located in positions corresponding, respectively, to end portions of each paper sheet on the movable plate as viewed along the longitudinal direction of the paper-supply roller, and said urging means is provided corresponding to the two individual backup members.

7. The paper feeding apparatus according to claim 1, further comprising a frame, said roller, movable plate and urging means being mounted to said frame, and said backup members being between said frame and said opening.

8. The paper feeding apparatus according to claim 1, wherein said roller is rotatably mounted in said frame to feed paper in a given direction, the axis of said roller being perpendicular to said given direction, said movable plate having a plane substantially parallel to said roller axis and to said given direction, and said backup member being movable by said urging means in a direction substantially perpendicular to the plane of said movable plate.

* * * * *